US008007313B2

(12) United States Patent
Deno et al.

(10) Patent No.: US 8,007,313 B2
(45) Date of Patent: Aug. 30, 2011

(54) ATTACHING STRUCTURE OF CONNECTOR

(75) Inventors: Masahiro Deno, Makinohara (JP); Yasukazu Chikamatsu, Makinohara (JP); Bunji Nomura, Toyota (JP); Tsuyoshi Hayashi, Toyota (JP); Hajime Oyanagi, Toyota (JP)

(73) Assignees: Yazaki Corporation, Tokyo (JP); Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 12/191,506

(22) Filed: Aug. 14, 2008

(65) Prior Publication Data

US 2009/0047812 A1 Feb. 19, 2009

(30) Foreign Application Priority Data

Aug. 14, 2007 (JP) ..... 2007-211283

(51) Int. Cl.
*H01R 13/73* (2006.01)
*H02B 1/01* (2006.01)

(52) U.S. Cl. ..... 439/545; 439/573

(58) Field of Classification Search ..... 439/573, 439/569–571, 562–565, 545, 361, 364, 79, 439/541.5

See application file for complete search history.

(56) References Cited

U.S. PATENT DOCUMENTS

| | | | | |
|---|---|---|---|---|
| 2,724,811 | A * | 11/1955 | Poupitch | 439/545 |
| 5,897,386 | A * | 4/1999 | Baxter et al. | 439/79 |
| 6,074,218 | A * | 6/2000 | Wu et al. | 439/63 |
| 7,326,063 | B1 * | 2/2008 | Raudenbush et al. | 439/581 |
| 2002/0173185 | A1 | 11/2002 | Fukushima et al. | |

FOREIGN PATENT DOCUMENTS

| | | | |
|---|---|---|---|
| JP | 04-076279 | U | 7/1992 |
| JP | 05-275868 | A | 10/1993 |
| JP | 06-029049 | U | 4/1994 |
| JP | 2002-343169 | A | 11/2002 |
| JP | 2003-100386 | A | 4/2003 |
| JP | 2005-170277 | A | 6/2005 |

OTHER PUBLICATIONS

Japanese Office Action dated Jul. 7, 2009.
German Office Action issued on Jan. 17, 2011 in the corresponding German Patent Application No. 102008038802.5.

* cited by examiner

*Primary Examiner* — Felix O Figueroa
(74) *Attorney, Agent, or Firm* — Sughrue Mion, PLLC

(57) ABSTRACT

An attaching structure of a connector for attaching a connector to an attached portion, includes: a holding unit which holds the connector at an attaching position by sliding the connector in a direction of intersecting with a superimposing direction of the connector and the attached portion to superimpose the connector on the attached portion; and a pair of holes provided at the connector and the attached portion for passing a screw member by being communicated with each other when the connector is disposed at the attaching position.

12 Claims, 11 Drawing Sheets

ATTACHING STRUCTURE OF CONNECTOR

BACKGROUND OF THE INVENTION

1. Technical Field

The present invention relates to an attaching structure of a connector for attaching a connector to an attached portion.

2. Background Art

A circuit breaker is provided in a power source circuit or the like of a hybrid vehicle or an electric automobile. The circuit breaker is attached to, for example, an attached portion of a battery pack or the like containing a battery at inside thereof. The circuit breaker includes a connector which is attached to the attached portion and contains a plurality of terminal metal pieces, a mating connector for conducting a power source circuit by electrically connecting terminal metal pieces of the connector when attached to the above-described connector and a lever attached to the mating connector movably (rotatably and slidably) (refer to, for example, JP-A-2002-343169 and JP-A-2003-100386).

According to the circuit breaker, when the mating connector is removed from the connector in a case in which an operator carries out maintenance of the power source circuit or the like, the power source circuit is cut and an operator is prevented from being electrified. Further, by holding the mating connector removed from the connector by the operator per se, the cut power source cannot be conducted again to firmly prevent the operator from being electrified.

The above-described connector is provided with a pair of holes and the attached portion is provided with a pair of holes communicating with respective holes of the pair of holes when the connector is exposed at an attaching position. The connector is attached to the attached portion by passing bolts through respective holes of the pairs of holes communicated with each other and screwing the bolts to nuts.

However, according to the above-described connector, the bolts need to be fastened at two portions for being fixed to the attached portion, and therefore, there poses a problem that time and labor are taken for an attaching operation, a number of components is large and cost is increased. Further, time and labor are taken similarly in a disassembling operation to pose a problem that a recycling performance is poor. Further, when the bolt is fastened at one portion in order to resolve the problems, there pose a problem that a strength of fixing to the attached portion is weakened.

SUMMARY OF THE INVENTION

It is an object of the invention to resolve the problems. That is, it is an object thereof to provide an attaching structure of a connector capable of solidly attaching a connector to an attached portion although an attaching operation is simple and cost is low.

In order to achieve the object by resolving the problem, there is provided an attaching structure of a connector for attaching a connector to an attached portion, the attaching structure including: a holding unit which holds the connector at an attaching position by sliding the connector in a direction of intersecting with a superimposing direction of the connector on the attached portion to superimpose the connector on the attached portion; and a pair of holes provided at the connector and the attached portion for passing a screw member by being communicated with each other when the connector is disposed at the attaching position.

According to the above configuration, the connector is fixed to the attached portion by one portion of bolt-fastening of fixing the holding unit and the pair of communicated holes by the screw member. Therefore, the connector can solidly be attached to be fixed at the attached portion despite that the operation is simple and cost is low.

In addition, the holding unit includes a groove portion provided at one of the connector and the attached portion, and a proceeding portion (also referred to as the inserting portion) provided at the other of the connector and the attached portion to be passed into the groove portion.

According to the above configuration, by passing the proceeding portion to the groove portion, the connector is disposed at the attaching position by is sliding the connector in the direction of intersecting with the direction of superimposing the connector and the attached portion and the connector is held in the superimposing direction. Therefore, the connector is disposed to be held at the attaching position by passing the proceeding portion to the groove portion. Therefore, the connector can simply be attached to the attached portion.

In addition, a difference between a width of the groove portion and a thickness of the proceeding portion is made smaller than an interval between a vicinity of the hole of the connector and a vicinity of the hole of the attached portion when the connector is disposed at the attaching position.

According to the above configuration, when the connector is attached to the attached portion to be fixed by passing the screw member through the hole of the connector and the hole of the attached portion communicated with each other, the vicinity of the hole of the connector and the vicinity of the hole of attached portion become proximate to each other relatively, the proceeding portion is pressed to the inner face of the groove portion, for example, the proceeding portion is plastically deformed and is held at inside of the groove portion. Therefore, the proceeding portion is not rattled at inside of the groove portion and strange sound by vibration or the like can be prevented from being brought about.

In addition, the groove portion is provided at an outer surface of the connector, and the proceeding portion is an outer edge of a notched portion provided at the attached portion.

According to the above configuration, by passing the outer edge of the notched portion through the groove portion, the connector is slid in the direction of intersecting with the direction of superimposing the connector and the attached portion to make the connector disposed at the attaching position and the connector is held in the superimposing direction. Therefore, the connector can simply be attached to the attached portion.

In addition, a pair of the notched portions are provided so that the hole of the attached portion is disposed between the pair of the notched portions, and a pair of the groove portions are provided so that the outer edges of the pair of notched portions passes through the pair of the groove portions, respectively.

According to the above configuration, the connector is further firmly held at the attached portion by passing the pair of notched portions through the pair of groove portions. Therefore, the connector can further solidly be attached to the attached portion.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
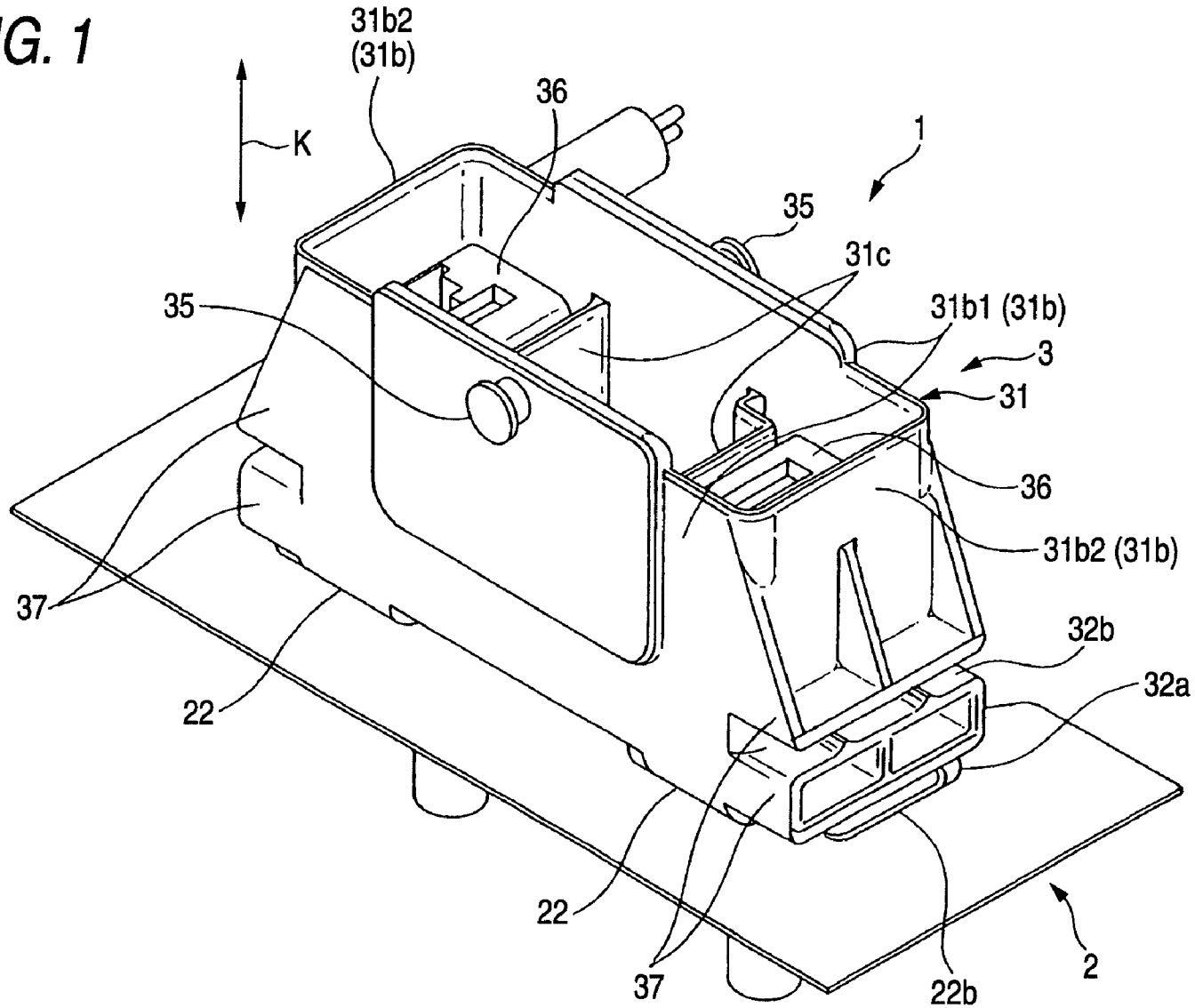
FIG. 1 is a perspective view showing an attaching structure of a connector according to a first embodiment of the invention.

An attaching structure 1 of a connector according to a first embodiment of the invention will be explained in reference to FIG. 1 through FIG. 8 as follows. The attaching structure 1 of the connector according to the first embodiment is an attaching structure for attaching a connector 3 constituting a circuit breaker 10 to an attached portion 2 of a battery pack (not illustrated) by a screw member 6 (FIG. 8) as shown in FIG. 7.

The battery pack is mounted to a hybrid vehicle as an automobile (an automobile runnable by both of a motor and an engine) or an electric automobile and attached to a panel or the like constituting a vehicle body of the hybrid vehicle or the electric automobile. The battery pack constitutes a power source circuit of the hybrid vehicle or the electric automobile. The battery pack includes a case member in a box-like shape having a synthetic resin or the like and a battery or the like contained at inside of the case member.

Figure 5:
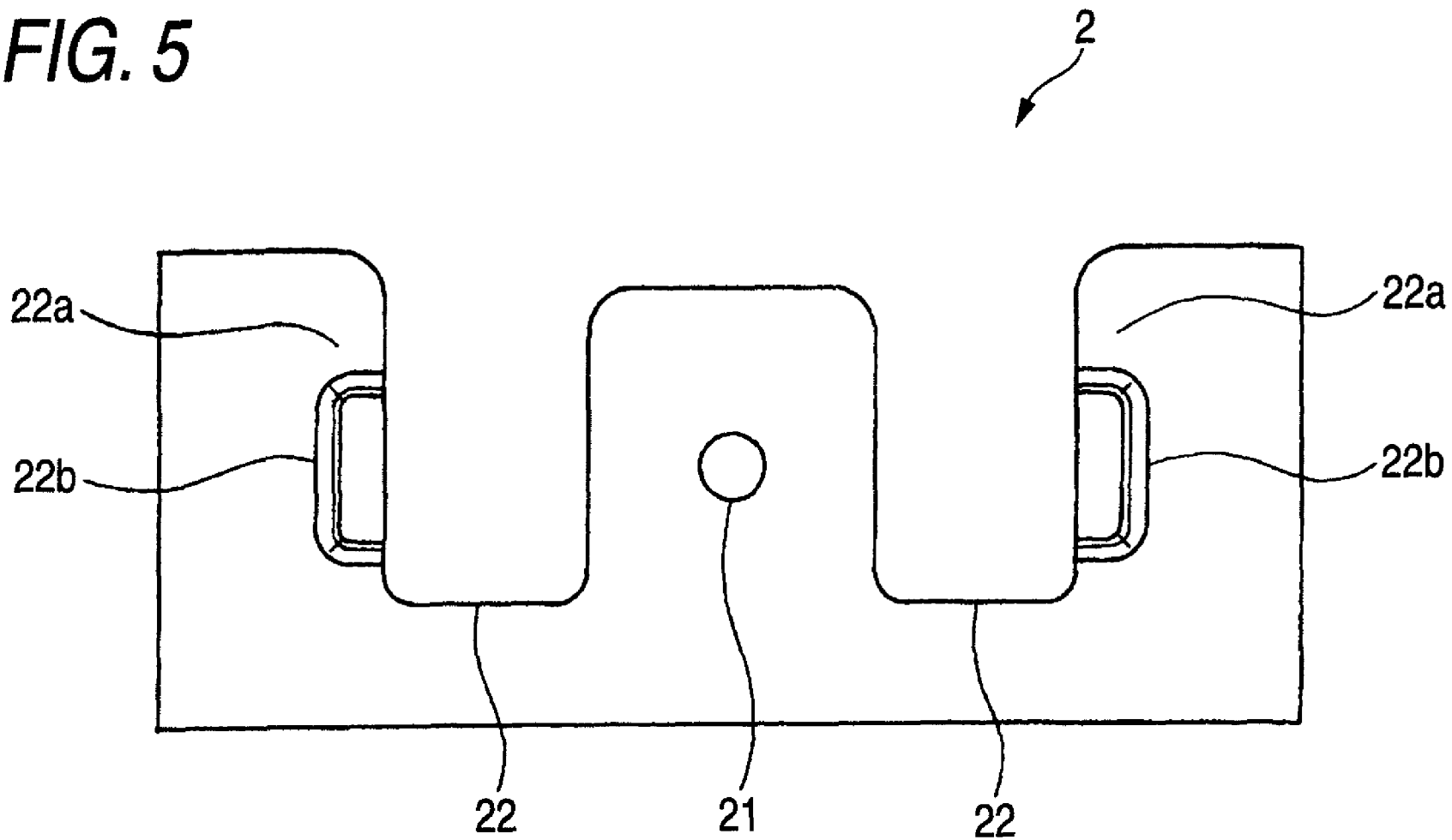
FIG. 5 is a top view showing an attached portion shown in FIG. 1.

An outer surface of the case member is provided with the attached portion 2 attached with the circuit breaker 10. The attached portion 2 is constituted by, for example, a sheet metal or the like. The attached portion 2 is formed by a shape of a flat plate and as shown in FIG. 5, a plane shape thereof is formed substantially in a rectangular shape. The attached portion 2 includes a hole 21 and a pair of notched portions 22.

One of the hole (in correspondence with one hole of a pair of holes) 21 is provided by penetrating the attached portion 2 and provided between the pair of notched portions 22. A plane shape of the hole 21 is formed by a circular shape. An inner diameter of the hole 21 is slightly larger than an outer diameter of a shaft portion of a bolt 61, mentioned later, of a screw member 6 and slightly smaller than an outer diameter of a head portion of the bolt 61. The shaft portion of the bolt 61 is passed through the hole 21.

The notched portion 22 is formed by notching the attached portion 2 from an end portion in a width direction of the attached portion 2 in the width direction, and a plane shape thereof is formed by substantially a rectangular shape. A pair of the notched portions 22 are provided to make the hole 21 disposed therebetween, and provided by being spaced apart from each other by an interval therebetween in a longitudinal direction of the attached portion.

In four outer edges of the pair of notched portions 22 along the width direction of the attached portion 2, two outer edges 22*a* disposed on outer sides (in correspondence with proceeding portions (also referred to as the inserting portions)) are passed into a groove portion 32*a* mentioned later of the connector 3. Further, the above-described two outer edges 22*a* of the notched portions 22 (hereinafter, simply referred to as outer edges 22*a*) constitute holding unit 7 along with the groove portions 32*a*.

The outer edge 22*a* is provided with a recess portion 22*b*. The recess portion 22*b* is provided substantially at a center of the outer edge 22*a* and a plane shape thereof is formed substantially in a rectangular shape. The recess portion 22*b* is provided to recess from an outer surface of the attached portion 22. Further, a thickness of the outer edge 22*a* indicates a depth of the recess portion 22*b*. Further, the recess portion 22*b* is not necessarily needed to be provided, and in that case, the thickness of the outer edge 22*a* indicates a plate thickness of the attached portion 2.

As shown in FIG. 7, the circuit breaker 10 includes the connector 3, a plug member 4 constituting a mating connector, and a lever 5 displaceably (rotatably and slidably) attached to the plug member 4. The circuit breaker 10 is integrated to a power source circuit and integrated to between a battery and a load of an electronic apparatus or the like.

Figure 2:
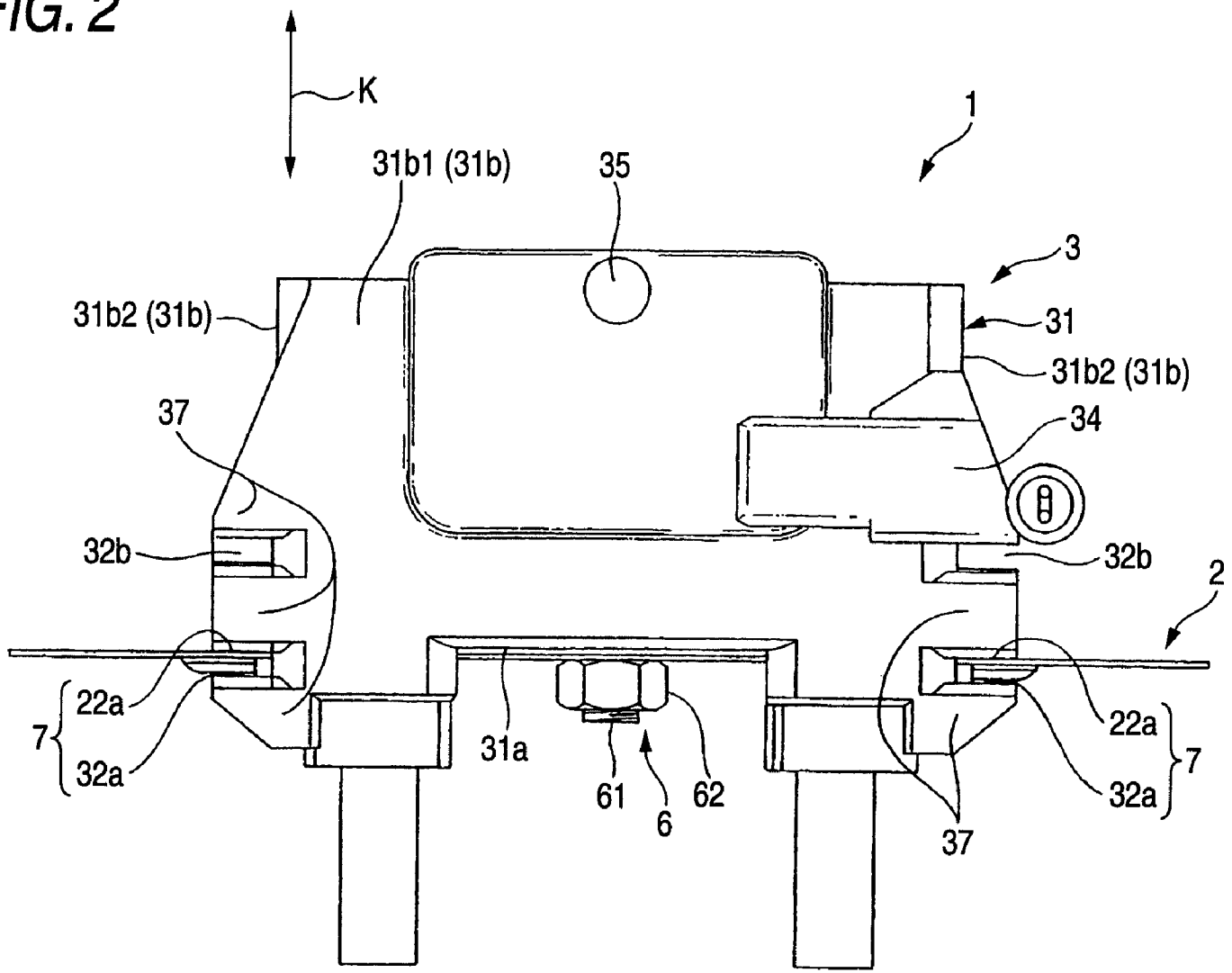
FIG. 2 is a side view of the attaching structure of the connector shown in FIG. 1.

The connector 3 is formed by an insulating synthetic resin or the like. As shown in FIG. 2, the connector 3 includes a connector housing (hereinafter, simply referred to as housing) 31, groove portions 32*a*, 32*b*, a hole (in correspondence with other hole of a pair of holes) 33 (FIG. 8) and a connector portion 34.

Figure 3:
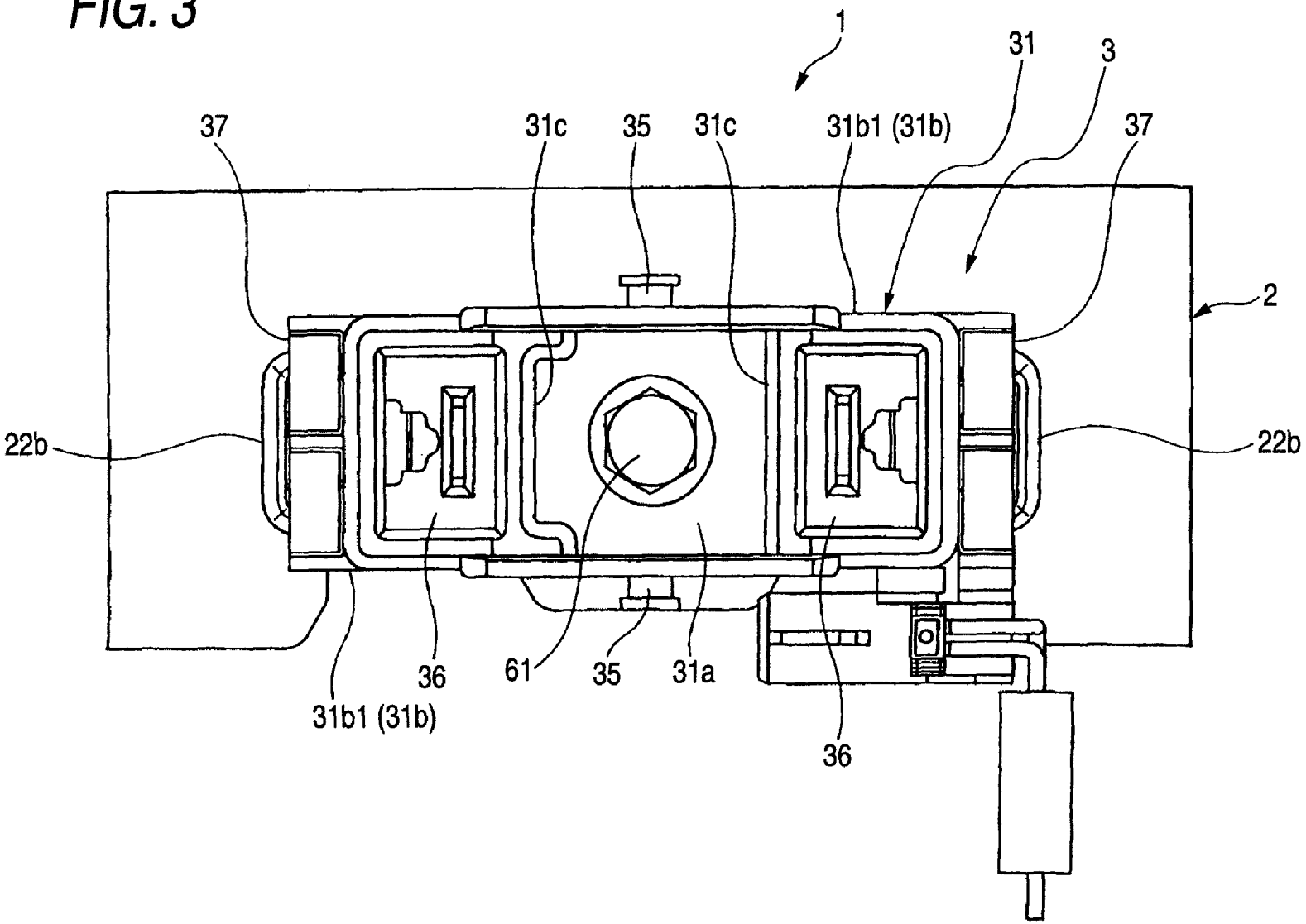
FIG. 3 is a top view of the attaching structure of the connector shown in FIG. 1.
Figure 4:
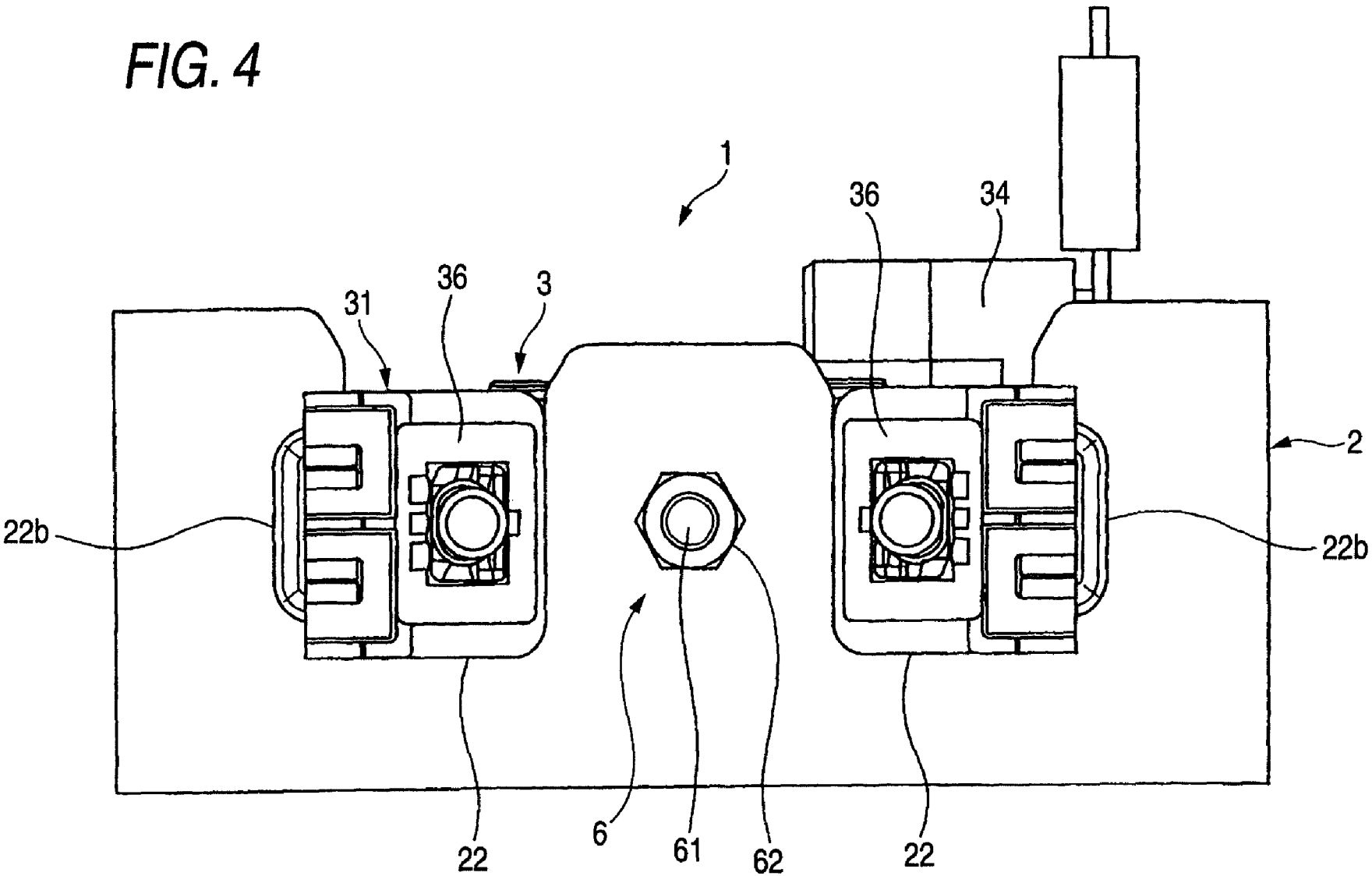
FIG. 4 is a bottom view of the attaching structure of the connector shown in FIG. 1.

The housing 31 is passed into the notched portions 22 of the attached portion 2. As shown in FIG. 3, the housing 31 includes a bottom wall 31*a* formed substantially in a flat plate shape, a peripheral wall 31*b* continuous to a peripheral edge of the bottom wall 31*a* and erected from the peripheral edge, and a partitioning wall 31*c* provided in parallel with the peripheral wall 31*b* for partitioning a space at inside of the peripheral wall 31*b* and is formed substantially by a shape of a bottomed square cylinder. The housing 31 is provided with a cam projection 35, a terminal containing portion 36, and a plurality of ribs 37.

The cam projection 35 is projected in an outer direction of the housing 31 from an outer surface of the housing 31. A plane shape of the cam projection 35 is formed by a circular shape. The cam projections 35 are respectively provided at a pair of peripheral walls 31*b*1 opposed to each other. The cam projection 35 is passed through a cam hole 55, mentioned later, of the lever 5.

Figure 8:
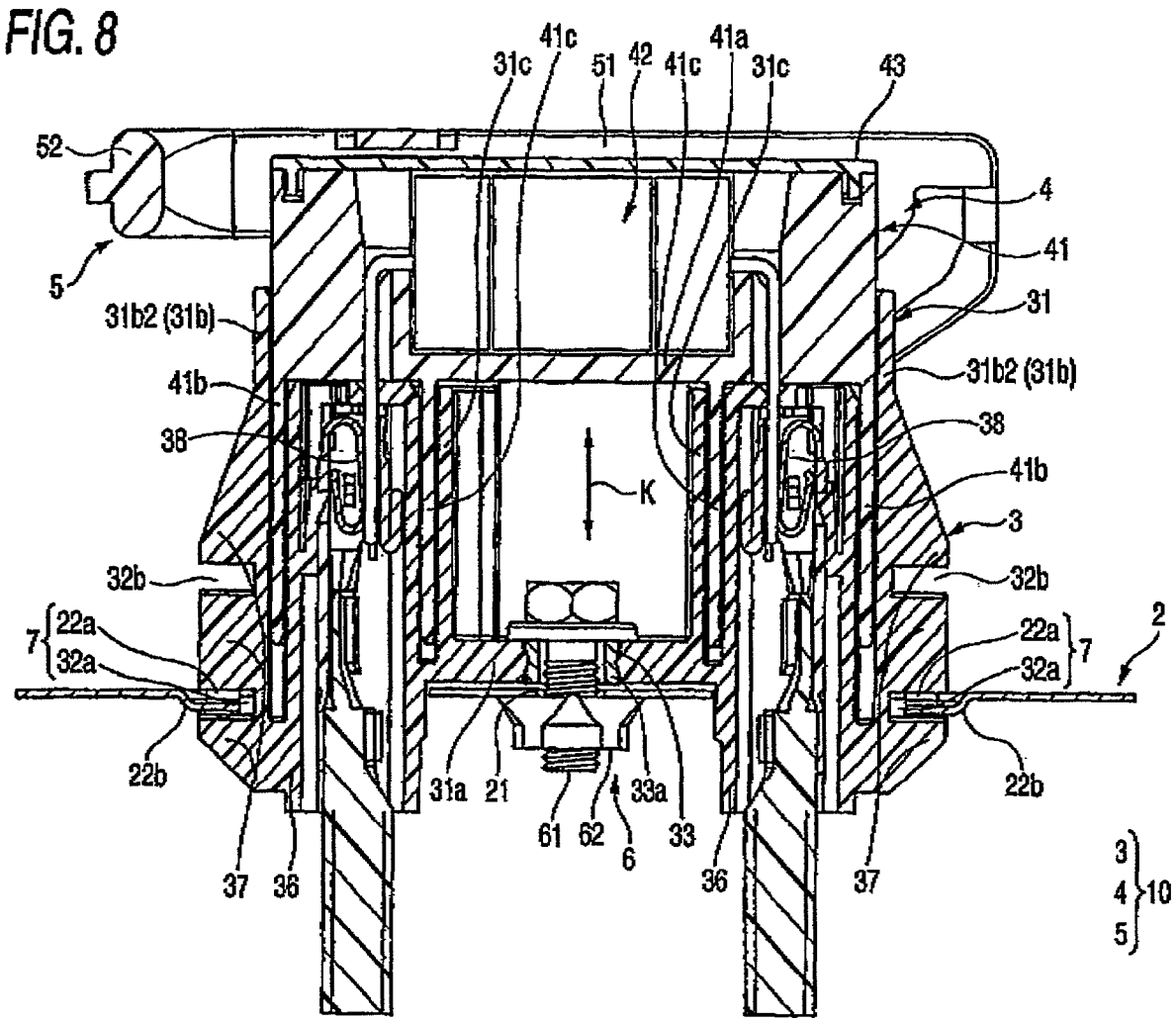
FIG. 8 is a sectional view showing a state of fitting the plug member to the connector shown in FIG. 7.

The terminal containing portion 36 is provided at inside of the housing 31 and provided to be spaced apart from the peripheral wall 31*b* and the peripheral wall 31*c* at inside of a space surrounded by the peripheral wall 31*b* and the peripheral wall 31*c*. As shown in FIG. 8, a pair of the terminal containing portions 36 are provided to make the hole 33 disposed therebetween. The terminal containing portion 36 is projected from the bottom wall 31*b*. The terminal containing portion 36 is provided in a cylindrical shape and contains a female type terminal metal piece (hereinafter, referred to as female terminal) 38 at inside thereof.

The female terminal 38 is formed by folding to bend a sheet metal. In an illustrated example, a pair thereof are provided. The pair of female terminals 38 are provided to be spaced apart from each other by an interval therebetween and constitutes an open power source circuit. The female terminal 38 is integrally provided with a wire contact portion and an electric contact portion.

The wire contact portion is electrically connected to a wire. The wire connecting portion of one female terminal 38 is connected to a terminal of a wire connected to a battery, and the wire connecting portion of other female terminal 38 is connected to a terminal of a wire connected to a load of an electronic apparatus of the like.

The electric contact portion is formed by a cylindrical shape and is provided with an elastic spring piece at inside of the electric contact portion. The elastic spring piece is electrically connected to a terminal of a fuse 42 by pressing the terminal of the fuse 42 mentioned later of the plug member 4 invading inside of the electric contact portion to an inner face of the electric contact portion. Further, the electric contact portion, that is, the female terminal 38 is electrically connected to the fuse 42.

The female terminal 38 having the above-described constitution is contained at inside of the terminal containing portion 36 in a state in which the electric contact portion is disposed on an outer side of the attached portion 2, that is, the battery pack, and the wire contact portion is disposed on an inner side of the attached portion 2, that is, the battery pack. Further, the pair of female terminals 38 are contained at inside of the terminal containing portion 36 and arranged in parallel with each other.

As shown in FIG. 2, and the like, the rib 37 is projected from an outer surface of the peripheral wall 31*b* in an outer direction of the housing 31. The ribs 37 are respectively provided at a pair of peripheral walls 31*b*2 opposed to each other (the pair of peripheral walls 31*b*2 which are not provided with the above-described cam projections 35). The rib 37 is provided along a direction orthogonal to an axis center of the housing 31. Respectively three of the ribs 37 are provided at the above-described pair of peripheral walls 31*b*2. The three ribs 37 are provided in parallel with each other and the groove portions 32*a*, 32*b* are formed among the ribs 37 contiguous to each other.

As shown in FIG. 1, the groove portions 32*a*, 32*b* are provided at the outer surface of the housing 31 and formed to recess in an inner direction of the housing 31 from the outer surface of the housing 31. The groove portions 31*a*, 31*b* are extended in a direction orthogonal to the axis center of the housing 31. The groove portions 32*a*, 32*b* are substantially in parallel with the bottom wall 31*a* in a depth direction (left and right direction in FIG. 2). Widths of the groove portions 32*a*, 32*b* are provided to be wider than a thickness of the outer edge 22*a* of the attached portion 2.

The groove portions 32*a*, 32*b* are provided at the respective peripheral walls 31*b*1 of the pair of peripheral walls 31*b*1 provided with the ribs 37. That is, the pairs of the groove portions 32*a*, 32*b* are respectively provided. The groove portion 32*a* is provided to be proximate to the attached portion 2 and the groove portion 32*b* is provided to be remote from the attached portion 2. According to the embodiment, the outer edges 22*a* of the pair of notched portions 22 are passed into the pair of groove portion 32*a*.

Figure 6:
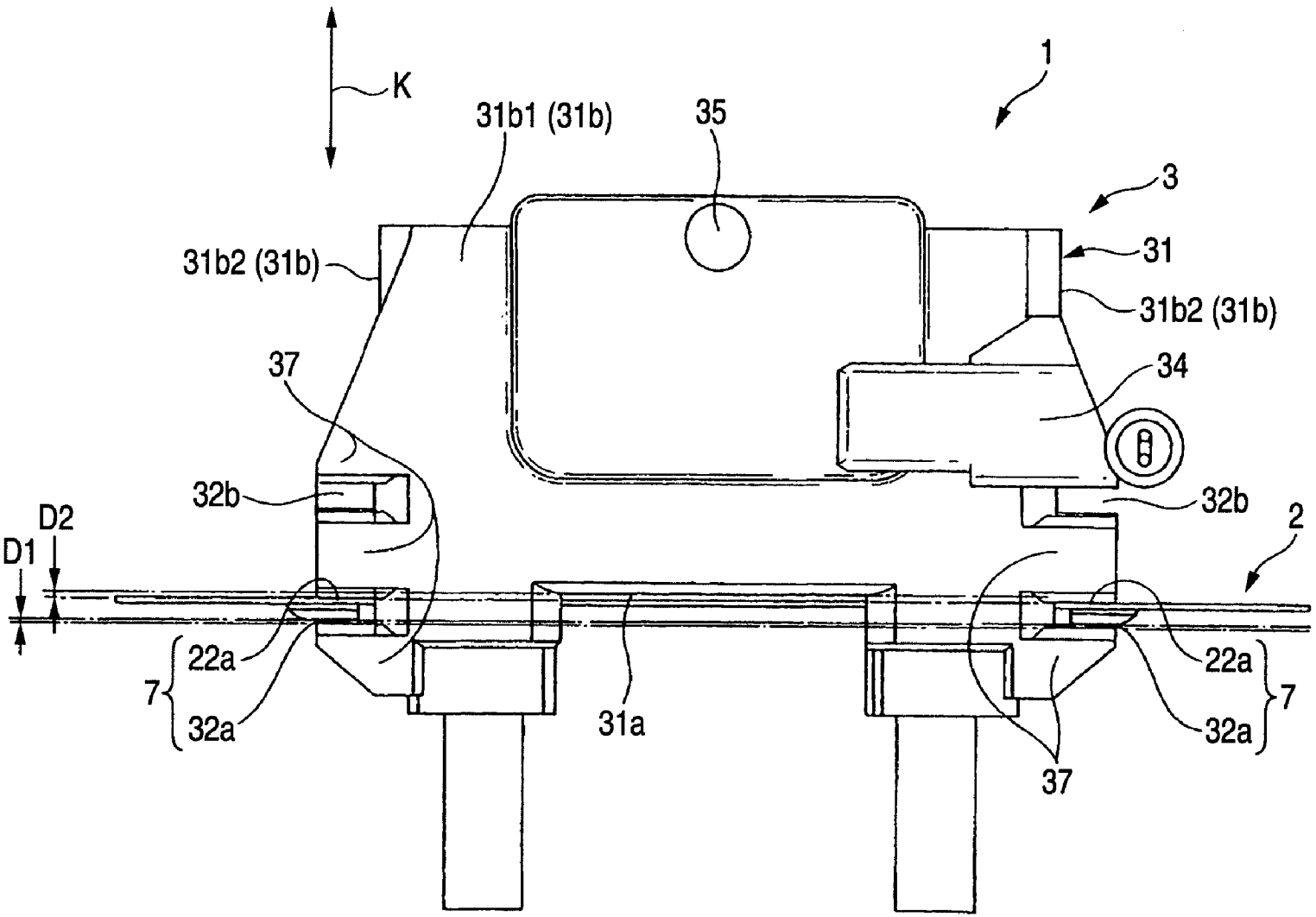
FIG. 6 is a side view showing a state before the connector shown in FIG. 1 is fixed by a screw member.
Figure 7:
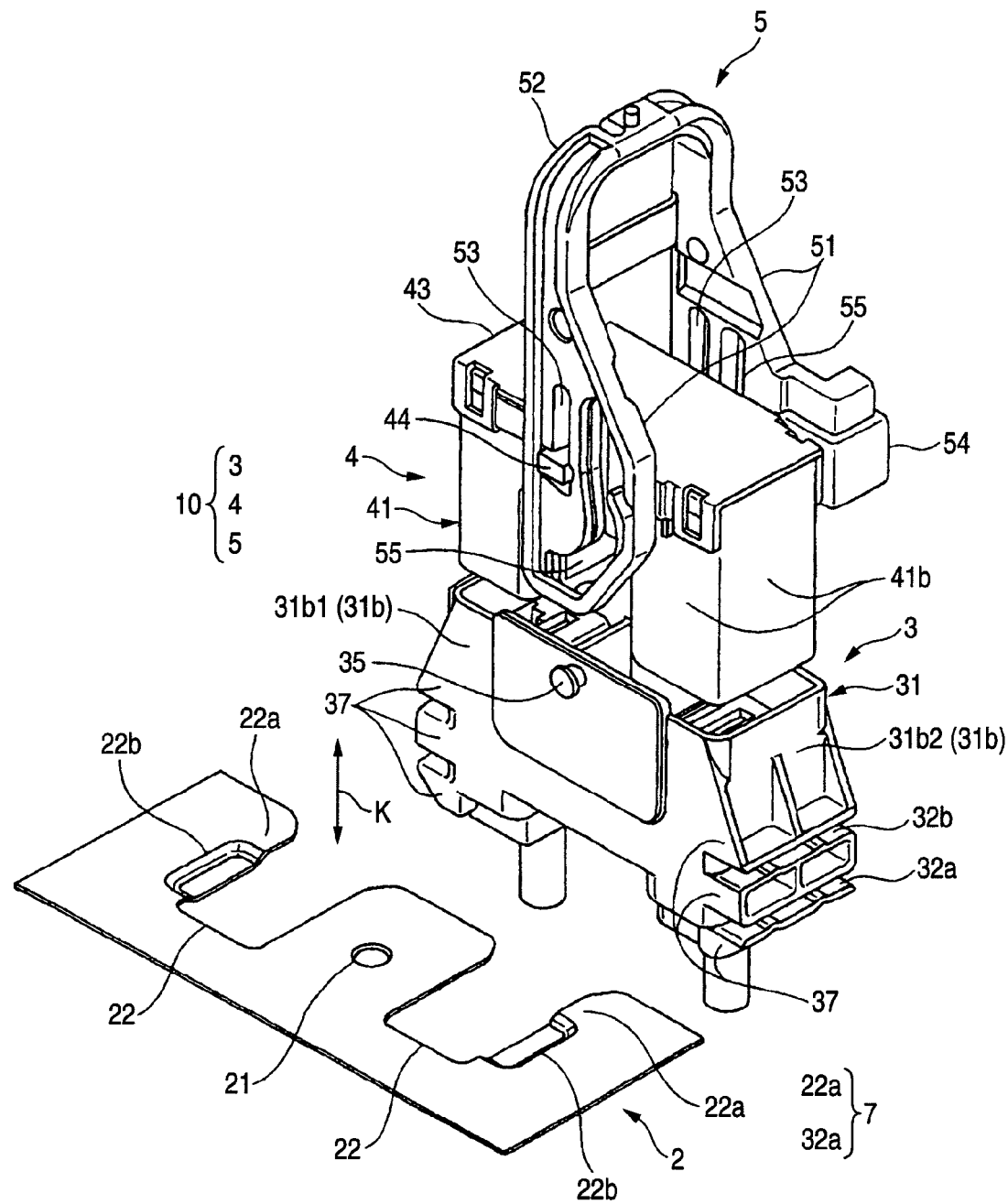
FIG. 7 is a perspective view showing a state in which a plug member is opposed to the connector shown in FIG. 1.

At this occasion, as shown in FIG. 6, a difference D1 between the width of the groove portion 32*a* and the thickness of the outer edge 22*a* (that is, an interval between the groove portion 32*a* and the outer edge 22*a* passed to inside of the groove portion 32*a*) is narrower than an interval D2 between a vicinity of the hole 33 of the connector 3 and a vicinity of the hole 21 of the attached portion 2 (that is, an interval between the bottom wall 31*a* and the attached portion 2 mentioned above). Further, the wall 31*a* is arranged to be remote from the attached portion 2 more than the inner face of the groove portion 32*a* proximate to the groove portion 32*b*.

The groove portion 32*a* provided at the connector 3 and the two outer edges 12*a* of the notched portion 22 provided at the attached portion 2 constitute the holding unit 7. The holding unit 7 holds the connector 3 by superimposing the connector 3 on the attached portion 2 at the attaching position by sliding the connector 3 in a direction orthogonal to a direction K of superimposing the connector 3 and the attached portion 2 (that is, a direction of the axis center of the housing 31 orthogonal to the attached portion 2).

Further, the position of attaching the connector 3 indicates a state in which one peripheral wall 31*b*1 of the pair of peripheral walls 31*b*1 provided with the cam projection 35 is brought into contact with the outer edge of the notched portion 22 along the longitudinal direction of the notched portion 2, and the bottom hole 31*a* is opposed to the attached portion 2 by being spaced apart from each other by an interval therebetween. At this occasion, the inner face remote from the groove portion 32*b* of the groove 32*a* is brought into contact with the outer edge 22*a* of the notched portion 22.

As shown in FIG. 8, the hole 33 is provided by penetrating the bottom wall 31*a*. One of the hole 33 is provided substantially at the center of the bottom wall 31*a* of the housing 31 and provided between the pair of terminal containing portions 36. A plane shape of the hole 33 is formed by a circular shape. A collar 33*a* in a cylindrical shape having a metal material is press-fitted to an inner side of the hole 33. An inner diameter of the collar 33*a* is slightly larger than the outer diameter of the shaft portion of the bolt 61 mentioned later and smaller than the outer diameter of the head portion of the bolt 61. The hole 33 (that is, the inner side of the collar 33*a*) is communicated with the hole 21 of the attached portion 2 when disposed at the attaching position. Further, the shaft portion of the bolt 61 of the screw member 6 is passed through the communicated holes 21, 33.

The connector portion 34 is provided to the outer surface of the housing 31 and arranged along the direction orthogonal to the axis center of the housing 31 as shown in FIG. 2 and the like. The connector portion 34 is formed by a cylindrical shape and contains the terminal at inside thereof. The terminal is arranged along the direction orthogonal to the axis center of the housing 31. The terminal is integrally provided with the wire connecting portion connected to the terminal of the wire and the electric contact portion electrically connected to a terminal of a connector portion 54 mentioned later of the plug member 4.

As shown in FIG. 7, the plug member 4 includes a connector housing (hereinafter, simply referred to as housing) 31, the fuse 42 (FIG. 8) press-fit to inside of the housing 41, and a cover 43 attached to the housing 41.

The housing 41 includes an insulating synthetic resin or the like. As shown in FIG. 8, the housing 41 is contained at inside of the housing 31 of the connector 3. The housing 41 includes an upper wall 41*a*, a peripheral wall 41*b* continuous to a peripheral edge of the upper wall 41*a* and erected from the peripheral edge, and a partitioning wall 41*c* provided in parallel with the peripheral wall 41*b* for partitioning a space at inside of the peripheral wall 41*b*, and formed substantially by a shape of a square cylinder. When the housing 41 is contained at inside of the housing 31 of the connector 3, the peripheral wall 41*b* is inserted to an inner side of the peripheral wall 31*b*, and the partitioning wall 41*c* is inserted between the partitioning wall 31*c* of the connector 3 and the terminal containing portion 36. That is, the terminal containing portion 36 is contained at a space surrounded by the peripheral wall 41*b* and the partitioning wall 41*c*. The housing 41 is provided with a guide projection 44.

As sown by FIG. 7, the guide projection 44 is projected in an outer direction of the housing 41 from an outer surface of the housing 41. A plane shape of the guide projection 44 is formed such that a longitudinal direction thereof is along a direction orthogonal to the axis center of the housing 41 and both ends in the longitudinal direction are formed substantially in a rectangular shape in a shape of a circular arc. The guide projection 44 is passed through a guide hole 53 mentioned later.

The lever 5 is formed by an insulating synthetic resin or the like. As shown in FIG. 7, the lever 5 includes a pair of arm portions arranged in parallel with each other to be spaced apart from each other by an interval therebetween, an operating portion 52 for connecting the pair of arm portions 51 to each other, and the connector portion 54. The arm portions 51 are respectively formed by a flat plate shape and superimposed on the peripheral wall 41*b* provided with the guide projection 44 of the plug member 4. The arm portion 51 is provided with the guide hole 53 and the cam hole 55.

The guide hole 53 is extended linearly along the longitudinal direction of the arm portion 51. The guide projection 44 of the plug member 4 is passed through the guide hole 53. The guide hole 53 includes a linear portion extended linearly and a circular portion provided at one end of the linear portion on a lower side in FIG. 7 (side remote from the operating portion 52). A width of the linear portion is slightly larger than a length in a width direction of the guide projection 44 (plane shape). An inner diameter of the circular portion is slightly larger than an outer diameter of the circular arc portion of the guide projection 44 (plane shape). Therefore, when the guide projection 44 is disposed at the linear portion, rotation of the lever 5 relative to the plug member 4 is restricted and when the guide projection 44 is disposed at the circular portion, the lever 5 is made to be rotatable relative to the plug member 4.

The cam hole 55 is extended in a longitudinal direction of the arm portion as a whole. The cam projection 35 of the connector 3 is passed through the cam hole 55. The cam hole 55 includes a linear portion extended linearly and a curved portion continuous to one end on a lower side of FIG. 7 of the linear portion (side remote from the operating portion 52). The curved portion is formed by a circular arc shape and is bent to be proximate to the circular portion of the guide hole 53 as being proximate to the one end of the linear portion.

The connector portion 54 is fitted to the connector portion 34 of the connector 3 after electrically connecting the fuse 42 and the female terminal 38 by fitting the plug member 4 and the connector 3 to each other. Further, when the connector portions 34, 54 are fitted to each other, the terminals of the connector portions 34, 54 are electrically connected and a switch portion of a relay provided between the connector portions 34, 54 is made ON. Only under the state, the power source circuit is conducted.

The lever 5 having the above-described constitution is attached to the plug member 4 by passing the guide projection 44 to the guide hole 53. Hereinafter, an explanation will be given of a procedure of conducting the power source circuit by displacing the lever 5. First, a front end of the housing 41 of the plug member 4 is inserted to inside of the housing 31 of the connector 3 and the cam projection 35 of the connector 3 is inserted to the cam hole 55.

At this occasion, the guide projection 44 is disposed at the circular portion of the guide hole 53 and the cam projection 35 is disposed at an end portion on a side of the curved portion of the cam hole 55. The lever 5 is disposed in parallel with the axis center of the housing 41 of the plug member 4 in the longitudinal direction of the arm portion 51. A position of the lever 5 at this occasion is defined as a rotation start position.

Thereafter, the lever 5 is rotated in a direction of being proximate to the connector 3. Then, the guide projection 44 is rotated in the circular portion of the guide hole 53 and the cam projection 35 is moved in a direction of being proximate to the linear portion at inside of the curved portion of the cam hole 55. The curved portion is bent to be proximate to the circular portion of the guide hole 53 as being proximate to the linear portion, and therefore, by rotating the lever 5, the plug member 4 and the connector 3 are proximate to be each other to be fitted to each other and the fuse 42 and the female terminal 38 are electrically connected.

At this occasion, the guide projection 44 is disposed at the circular portion of the guide hole 53 and the cam projection 35 is disposed between the curved portion and the linear portion of the cam hole 55. The lever 5 is orthogonal to the axis center of the housing 41 of the plug member 4 (and housing 31 of connector 3) in the longitudinal direction of the arm portion 51. A position of the lever 5 at this occasion is defined as a rotation finish position.

Further, the lever 5 is slid in a direction in which the operating portion 52 is proximate to the plug member 4. At this occasion, the guide projection 44 is disposed at an end portion on a side of the linear portion of the guide hole 53 and the cam projection 35 is disposed at an end portion on a side of the linear portion of the cam hole 55. The lever 5 is orthogonal to the axis center of the housing 41 of the plug member 4 (and connector 3) in the longitudinal direction of the arm portion 51. A position of the lever 5 at this occasion is defined as a fitting finish position.

As shown in FIG. 2, the screw member 6 includes a bolt 61 and a nut 62. The bolt 61 is integrally provided with a shaft portion substantially in a shape of a circular pillar and a head portion formed at one end of the shaft portion. The shaft portion is formed with the screw groove. When the connector 3 is attached to the attached portion 2 and the holes 33, 21 are communicated with each other, the shaft portion of the bolt 61 is passed into the holes 21, 33 communicated with each other from a side of the hole 33 of the connector 3 and a front end of the shaft portion is projected to a side of the attached portion 2.

The nut 62 is formed with the screw groove at inside thereof which is screwed with the shaft portion of the bolt 61 projected to the side of the attached portion 2. By screwing the bolt 61 to the nut 62, the bottom wall 31*a* of the connector 3 and the attached portion 2 are pinched by the head portion of the bolt 61 and the nut 62 to be fixed. Further, the connector 3 is attached to the attached portion 2.

When the connector 3 of the above-described constitution is attached to the attached portion 2, first, the connector 3 is slid in the direction orthogonal to the direction K of superimposing the connector 3 and the attached portion 2 to thereby pass the housing 31 of the connector 3 through the notched portion 22 of the attached portion 2 and the outer edge 22*a* of the notched portion 22 is passed through the groove portion 32*a*. Then, the hole 33 of the connector 3 and the hole 21 of the attached portion 2 are communicated with each other, and therefore, the communicated holes 33, 21 are screw-fastened by the bolt 61 and the nut 62.

When the attached portion 2 and the bottom wall 31*a* provided with the hole 33 are screw-fastened, the outer edge 22*a* of the notched portion 22 is pressed to an inner face of the groove portion 32*a* proximate to the groove portion 32*b*, and the outer edge 22*a* of the notched portion 22 is fixed to inside of the groove portion 32*a*. The connector 3 is attached to the attached portion 2 as described above.

Thereafter, the plug member 4 is attached to the connector 3 attached to the attached portion 2 to thereby conduct the power source circuit. First, a front end of the housing 41 of the plug member 4 is inserted to inside of the housing 31 of the connector 3, and the cam projection 35 is inserted into the cam hole 55 of the lever 5. The lever 5 is positioned to the above-described rotation start position.

Further, the lever 5 is rotated in the direction of being proximate to the connector 3, that is, the above-described rotation finish position, and the fuse 42 and the female terminal 38 are electrically connected by fitting the plug member 4 and the connector 3. Further, the operating portion 52 of the lever 5 is slid in a direction of being proximate to the plug member 4, that is, at the above-described fitting finish position, the connector portions 34, 54 are fitted to each other and the terminals are electrically connected. The power source circuit is conducted by displacing the lever 5 as described above.

In order to cut the power source circuit, an operation up to the point may be carried out in a reverse order. After cutting the power source circuit in this way, an operator carries out maintenance of the battery pack or the like. By holding the plug member 4 by the operator per se, other person cannot conduct the cut power source circuit and the operator can safely carries out the operation.

According to the embodiment, the holding unit 7 and the pair of holes 21, 33 communicated with each other when the connector 3 is positioned to an attaching position are provided, and therefore, by bolt-fastening at one portion of fixing the holding unit 7 and the pair of holes 21, 33 by the screw member 6, the connector 3 is fixed to the attached portion 2. Therefore, the connector 3 can solidly be attached to the attached portion 2 despite that the operation is simple and cost is low.

The holding unit 7 includes the groove 32*a* and the outer edge 22*a* of the notched portion 22 passed to inside of the groove portion 32*a*, and therefore, by passing the outer edge 22*a* to the groove portion 32*a*, the connector 3 is disposed at the attaching portion to be held. Therefore, the connector 3 can simply be attached to the attached portion 2.

A difference D1 between a width of the groove portion 32*a* and a thickness of the outer edge 22*a* of the notched portion 22 is provided to be smaller than an interval D2 between a vicinity of the hole 33 of the connector 3 and a vicinity of the hole 21 of the attached portion 2 disposed at the attaching position, and therefore, when the pair of communicated holes 21, 33 are fixed by the screw member 6, the outer edge 22*a* is pressed to the inner face of the groove portion 32*a* and is held at inside of the groove portion 32*a*. Therefore, the outer edge 22*a* is not rattled at inside of the groove portion 32*a* and strange sound by vibration or the like can be prevented from being brought about.

Respective pairs of the notched portions 22 and the groove portion 32*a* are provided, and therefore, by passing the outer edges 22*a* of the pair of notched portions 22 through the pair of groove portions 32*a*, the connector 3 can further firmly be held by the attached portion 2. Therefore, the connector 3 can be attached to the attached portion 2 further solidly.

In the above-described embodiment, the connector 3 constitutes the circuit breaker 10 and the plug member 4 is attached to the connector 3. However, according to the invention, the connector 3 may not constitute the circuit breaker 10, for example, the connector 3 may be attached with a connector attached to a terminal of a wire of a wire harness.

Further, according to the above-described embodiment, the groove portion 32*a* and the outer edge 22*a* of the notched portion 22 are provided such that the connector 3 is slid in the direction orthogonal to the direction K of superimposing the connector 3 and the attached portion 2. However, according to the invention, the groove portion 32*a* and the outer edge 22*a* of the notched portion 22 may naturally be provided such that the connector 3 is slid in a direction of intersecting with the superimposing direction K without being orthogonal thereto.

Further, according to the above-described embodiment, the groove portion 32*a* is provided to the connector 3, and the outer edge 22*a* passed through the groove portion 32*a* is provided to the attached portion 2. However, according to the invention, for example, a rib may be provided at the connector 3 and the groove portion of passing the rib may be provided at the attached portion 2.

Figure 9:
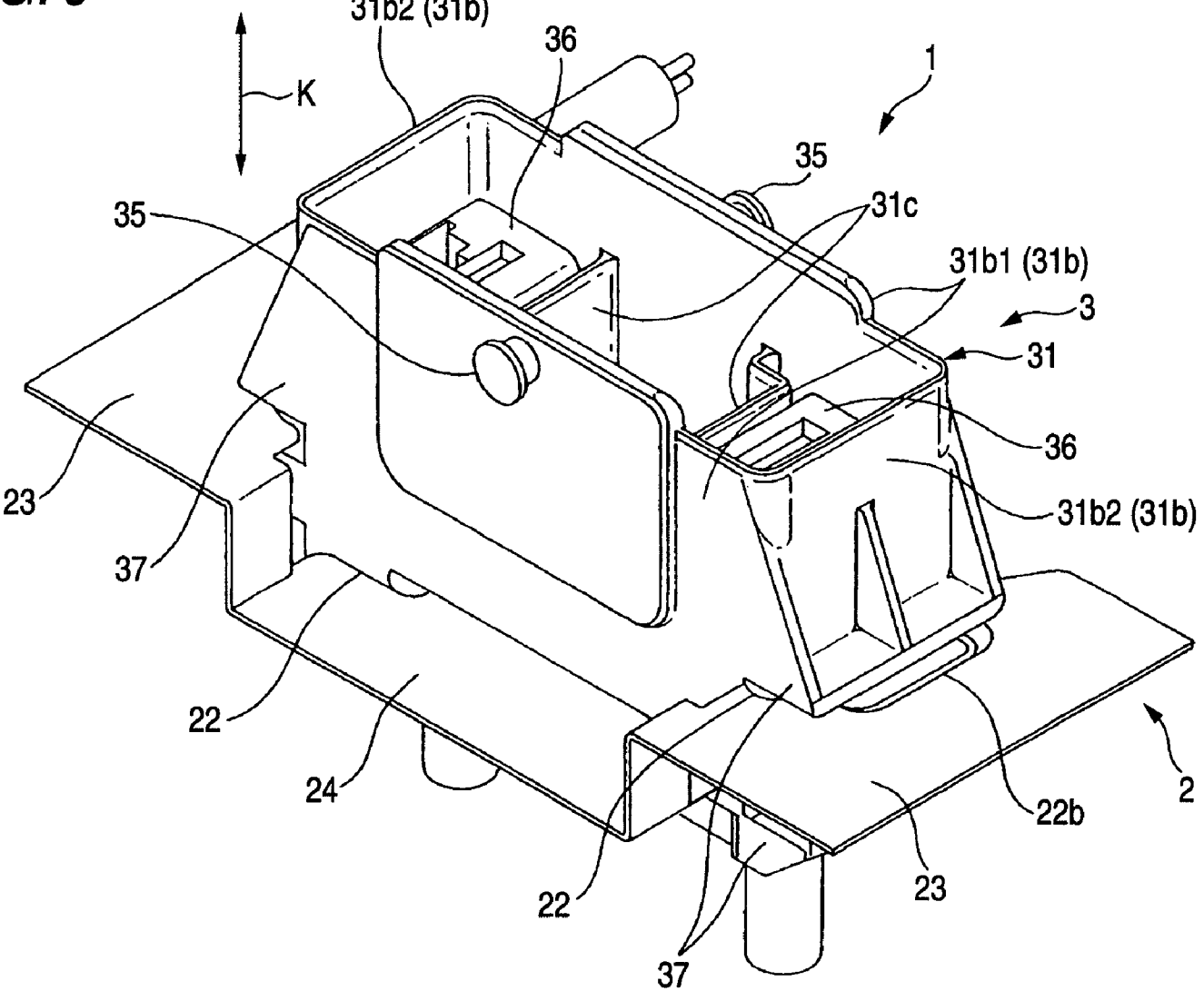
FIG. 9 is a perspective view showing an attaching structure of a connector according to a second embodiment of the invention.

Next, the attaching structure 1 of the connector according to a second embodiment will be explained in reference to FIG. 9 through FIG. 11. Further, constitution portions same as those of the above-described first embodiment are noted with the same numerals and signs and an explanation thereof will be omitted.

A difference of the embodiment from the first embodiment resides in two points of that a shape of the attached portion 2 differs and that the outer edge 22*a* of the notched portion 22 of the attached portion 2 is passed to inside of the groove portion 32*b*. The outer edge 22*a* of the notched portion 22 and the groove portion 32*b* constitute the holding unit 7.

The attached portion 2 is formed by folding to bend a sheet metal or the like. As shown in FIG. 11, a plane shape of the attached portion 2 is formed in a rectangular shape. As shown in FIG. 9, the attached portion 2 is integrally provided with a flat plate portion 23 and a stepped portion 24 a section of which is formed by a channel-like shape. The stepped portion 24 is provided at a center in a longitudinal direction of the attached portion 2 and is provided over a total in a width direction of the attached portion 2. The hole 21 is provided at a bottom portion of the stepped portion 24 in parallel with the flat plate portion 23.

The notched portion 22 is formed by notching the attached portion 2 from an end portion in the width direction of the attached portion along the width direction and over the flat plate portion 23 and the stepped portion 24. A pair of the notched portions 22 are provided to be spaced apart from each other by an interval therebetween along the longitudinal direction of the attached portion 2. Two outer edges (in correspondence with the proceeding portions. Hereinafter, simply referred to as outer edges) 22*a* on sides of the flat plate portions 23 of the pair of notched portions 22 are passed to inside of the pair of groove portions 32*b*.

Figure 10:
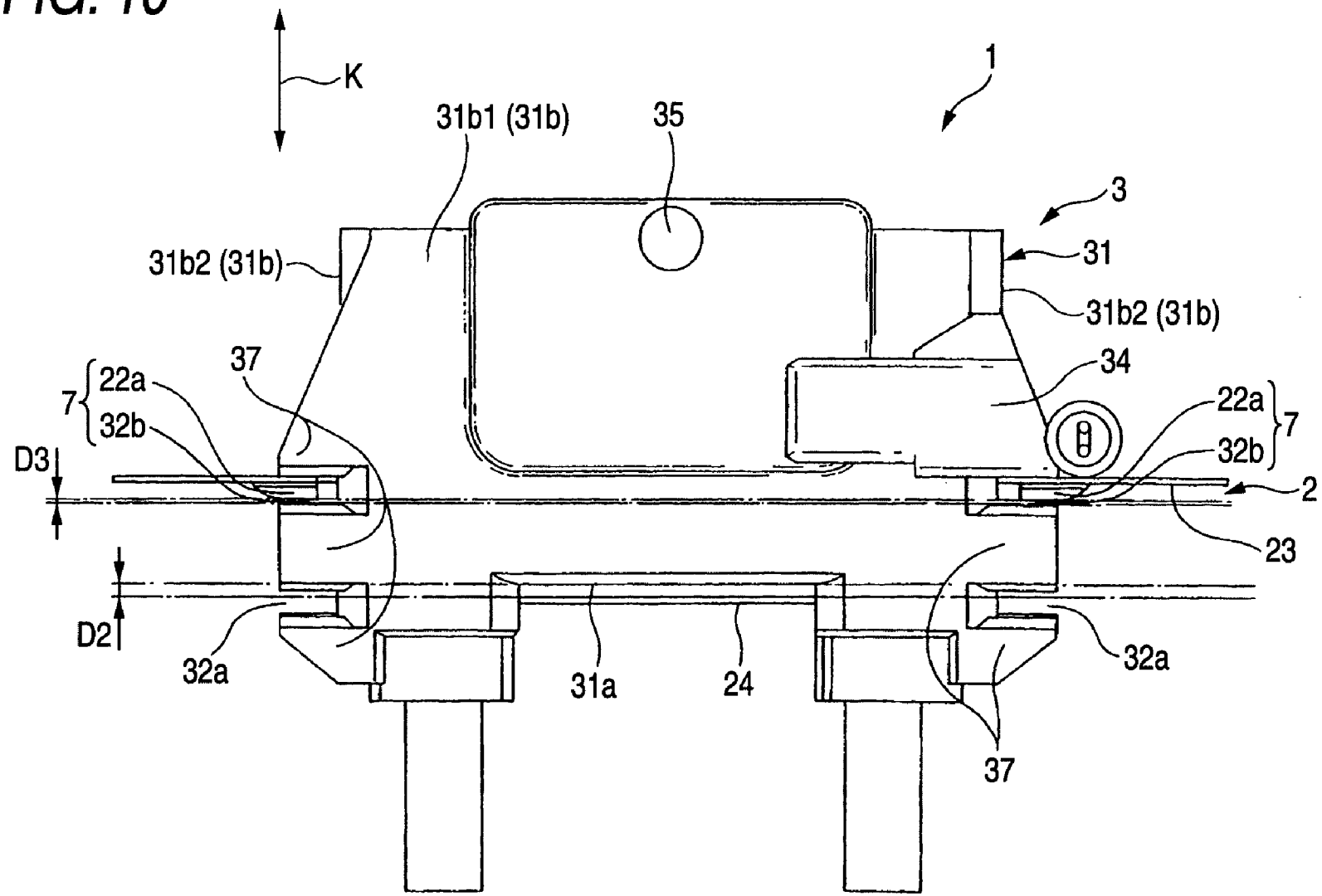
FIG. 10 is a side view showing a state before fixing the connector shown in FIG. 9 by a screw member.
Figure 11:
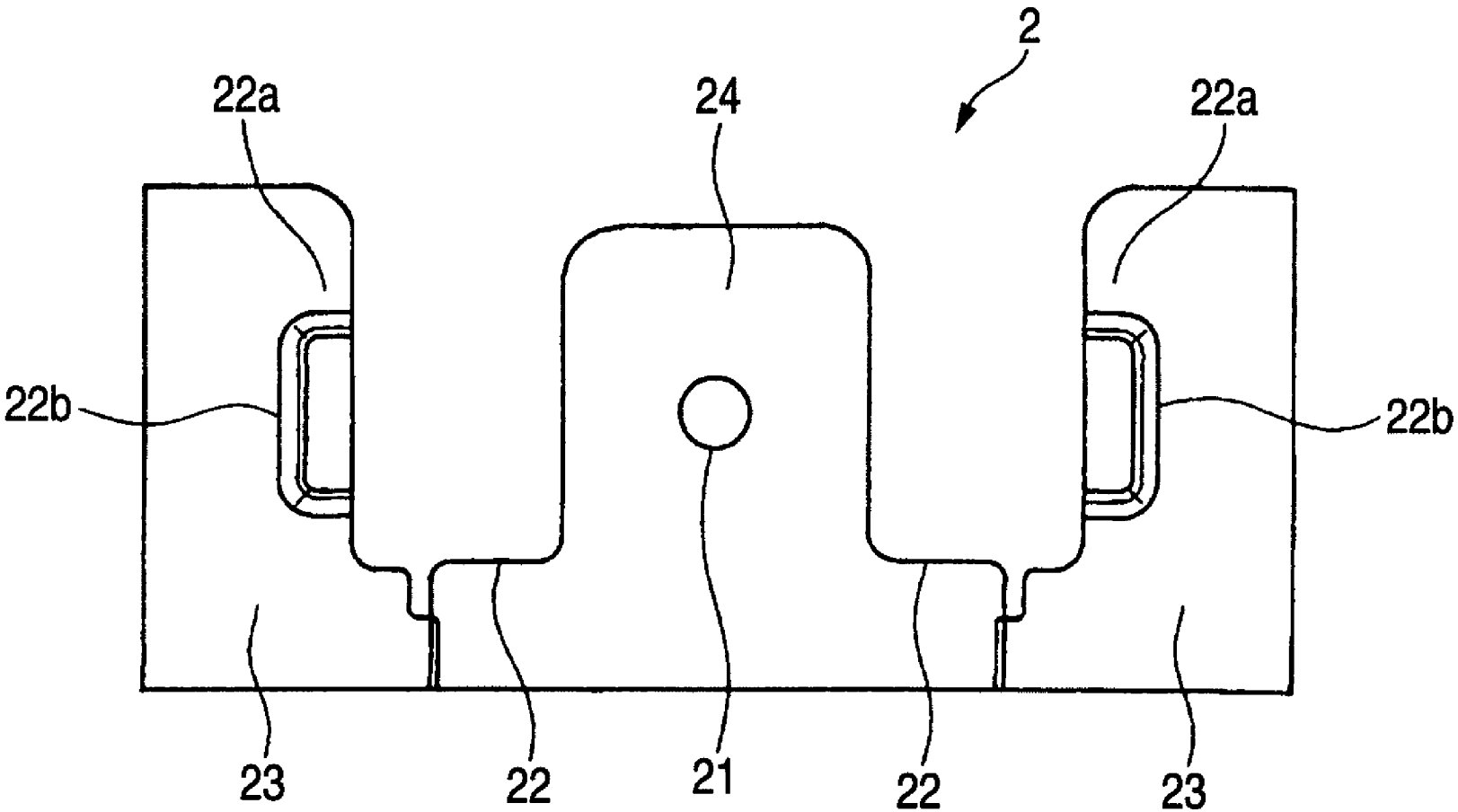
FIG. 11 is a top view showing an attached portion shown in FIG. 9.

At this occasion, as shown in FIG. 10, a difference D3 between a width of the groove portion 32*b* and a thickness of the outer edge 22*a* (that is, an interval between the groove portion 32*b* and the outer edge 22*a* passed to inside of the groove portion 32*b*) is narrower than the interval D2 between the vicinity of the hole 33 of the connector 3 and the vicinity of the hole 21 of the attached portion 2 (that is, an interval between the bottom wall 31 a of the connector 3 and a bottom portion of the stepped portion 24 of the attached portion 2).

Also in the embodiment, an advantage similar to that of the first embodiment can be achieved. That is, according to the embodiment, the holding unit 7 and the pair of holes 21, 33 communicated with each other when the connector 3 is disposed at the attaching position are provided, and therefore, by bolt-fastening at one portion of fixing the holding unit 7 and the pair of holes 21, 33 by the screw member 6, the connector 3 is fixed to the attached portion 2. Therefore, the connector 3 can solidly be attached to fix the attached portion 2 despite that the operation is simple and cost is low.

The holding unit 7 includes the groove portion 32*b* and the outer edge 22*a* of the notched portion 22 passed to inside of the groove portion 32*b*, and therefore, the connector 3 is disposed at the attaching position to be held by passing the outer edge 22*a* through the groove portion 32*b*. Therefore, the connector 3 can simply be attached to the attached portion 2.

The difference D3 between the width of the groove portion 32*b* and the thickness of the outer edge 22*a* of the notched portion 22 is provided to be smaller than the interval D2 between the vicinity of the hole 33 of the connector 3 and the vicinity of the hole 21 of the attached portion 2 disposed at the attaching position, and therefore, when the pair of communicated holes 21, 33 are fixed by the screw member 6, the outer edge 22*a* is pressed to the inner face of the groove portion 32*b* and is held at inside of the groove portion 32*b*. Therefore, the outer edge 21*a* is not rattled at inside of the groove portion 32*b* and strange sound by vibration or the like can be prevented from being brought about.

The pairs of the notched portions 22 and the groove portions 32*b* are respectively provided, by passing the pair of notched portion 22 through the pair of groove portions 32*b*, the connector 3 can further firmly be held by the attached portion 2. Therefore, the connector 3 can further solidly be attached to the attached portion 2.

Further, the above-described embodiments only show representative modes of the invention, and the invention is not limited to the embodiments. That is, the invention can be modified to embody variously within the range not deviated from the essence of the invention.

What is claimed is:

1. An attaching structure for attaching a connector to an attached portion, the attaching structure comprising:

a pair of notched portions provided in the attached portion to be spaced apart from each other;

a first hole provided in the attached portion between the pair of notched portions so that a straight line extending from at least one point on one of the pair of notched portions to at least one point on the other of the pair of notched portions intersects the first hole;

first holding portions which are provided on each of the pair of the notched portions;

second holding portions which are provided on the connector and are attached to the first holding portions of the attached portion, respectively, by sliding the connector relative to the attached portion to superimpose the connector on the attached portion; and a second hole provided in the connector for passing a fixing member into the first and second holes when the connector is disposed at an attaching position, wherein:

the first holding portions are inserting portions being outer edges of the pair of notched portions, respectively, provided in the attached portion, the second holding portions are a pair of groove portions being provided at outer surfaces of the connector, the outer edges of the pair of notched portions pass through the pair of groove portions, respectively, each of the groove portions define a generally U-shaped channel comprising two legs, and each of the outer edges are received between the two legs of the respective groove portion when the connector is disposed at the attaching position.

2. The attaching structure according to claim 1, wherein a difference between a width of the groove portion and a thickness of the inserting portion is smaller than an interval between a vicinity of the second hole of the connector and a vicinity of the first hole of the attached portion when the connector is disposed at the attaching position.

3. The attaching structure according to claim 1, wherein a recess portion is formed on the outer edge of the notched portion.

4. The attaching structure according to claim 1, wherein another groove portion is provided on the outer surface of the connector above the groove portion for receiving the inserting portion.

5. The attaching structure according to claim 4, wherein the outer edge of the notched portion is formed on a plane which differs from a plane in which the first hole of the attached portion is formed, and wherein the outer edge of the notched portion is inserted into the other groove portion.

6. The attaching structure according to claim 1, wherein the fixing member is a screw member.

7. The attaching structure according to claim 1, wherein the fixing member is a bolt.

8. A combination of a circuit breaker and a battery pack, wherein the circuit breaker is attached to the battery pack through the use of the attaching structure according to claim 1.

9. The attaching structure according to claim 1, wherein the connector includes a pair of grooves, and wherein the pair of notched portions each have an edge that is to be inserted into the pair of grooves respectively.

10. The attaching structure according to claim 1, wherein the attached portion is made of a sheet metal.

11. The attaching structure according to claim 1, wherein the fixing member is passed into the first and second holes in a passing direction, and wherein the outer edges of the pair of notched portions and the pair of groove portions cooperate with each other so as to prevent movement of the attached portion relative to the connector in the passing direction when the connector is disposed at the attaching position.

12. The attaching structure according to claim 1, wherein the fixing member is passed into the first and second holes in a passing direction, and wherein a straight line extending from one of the two legs to the other of the two legs in the passing direction intersects the outer edge of the respective notch portion when the connector is disposed at the attaching position.

* * * * *